US010767139B2

(12) United States Patent
Meier et al.

(10) Patent No.: US 10,767,139 B2
(45) **Date of Patent: *Sep. 8, 2020**

(54) SYNERGISTIC PROTEIN SOIL REMOVAL THROUGH NOVEL CHELATOR COMBINATION

(71) Applicant: ECOLAB USA INC., Saint Paul, MN (US)

(72) Inventors: Timothy Meier, Saint Paul, MN (US); David Dotzauer, Saint Paul, MN (US); Tobias Neil Foster, Cologne (DE); John Mansergh, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/554,347

(22) PCT Filed: Mar. 4, 2015

(86) PCT No.: PCT/EP2015/054541

§ 371 (c)(1),
(2) Date: Aug. 29, 2017

(87) PCT Pub. No.: WO2016/138954

PCT Pub. Date: Sep. 9, 2016

(65) Prior Publication Data

US 2018/0044613 A1 Feb. 15, 2018

(51) Int. Cl.

| | |
|---|---|
| ***C11D 1/72*** | (2006.01) |
| ***C11D 3/06*** | (2006.01) |
| ***C11D 3/33*** | (2006.01) |
| ***C11D 3/10*** | (2006.01) |
| ***C11D 11/00*** | (2006.01) |
| ***C11D 1/66*** | (2006.01) |

(52) U.S. Cl.

CPC ..... *C11D 3/33* (2013.01); *C11D 1/66* (2013.01); *C11D 3/06* (2013.01); *C11D 3/10* (2013.01); *C11D 11/0023* (2013.01)

(58) Field of Classification Search

CPC .... C11D 1/66; C11D 3/06; C11D 3/10; C11D 3/33; B08B 3/04; B08B 3/08; B08B 3/10

USPC ..... 510/222, 224, 228, 480, 499, 505, 506; 134/25.2

See application file for complete search history.

(56) References Cited

U.S. PATENT DOCUMENTS

| | | | | |
|---|---|---|---|---|
| 9,139,799 | B1 * | 9/2015 | Parte | C11D 3/3757 |
| 9,546,345 | B2 * | 1/2017 | Foster | C11D 3/06 |
| 10,017,718 | B2 * | 7/2018 | Foster | C11D 3/06 |
| 2009/0075855 | A1 * | 3/2009 | Gibis | C11D 3/33 510/224 |
| 2011/0017239 | A1 * | 1/2011 | VanLoyen | C11D 3/3769 134/25.2 |
| 2013/0017989 | A1 * | 1/2013 | Dailey | C11D 3/08 510/533 |
| 2013/0210692 | A1 * | 8/2013 | Gutowski | C11D 3/3749 510/219 |
| 2013/0274167 | A1 * | 10/2013 | Gutowski | C11D 3/33 510/218 |

FOREIGN PATENT DOCUMENTS

| | | | |
|---|---|---|---|
| GB | 2311538 | A | 10/1997 |
| JP | 11349989 | | 12/1999 |
| JP | 2008050410 | | 3/2008 |
| JP | 6212219 | B2 | 11/2016 |
| WO | 2007052004 | A1 | 5/2007 |
| WO | 2011100344 | A1 | 8/2011 |
| WO | 2013122978 | A1 | 8/2013 |
| WO | 2015032447 | A1 | 3/2015 |

OTHER PUBLICATIONS

Ecolab USA Inc., "Notification of Transmittal of the International Search Report and the Written Opinion of the International Searching Authority, or the Declaration," filed in connection to PCT/EP2015/05451, dated Dec. 7, 2015.

* cited by examiner

*Primary Examiner* — Gregory R Delcotto
(74) *Attorney, Agent, or Firm* — McKee, Voorhees & Sease, PLC

(57) ABSTRACT

The invention relates to a concentrated detergent composition comprising surfactant, alkali metal carbonate, methylglycinediacetic acid, glutamic acid N,N-diacetic acid, and alkali metal tripolyphosphate. The composition is particularly suited to remove protein soil in warewashing applications.

13 Claims, 1 Drawing Sheet

| | | | | | |
|---|---|---|---|---|---|
| | T | G | G | T | |
| | P | G | G | P | |
| | | G | G | | |
| | T | G | G | T | |
| | P | G | G | P | |
| | | G | G | | |

SYNERGISTIC PROTEIN SOIL REMOVAL THROUGH NOVEL CHELATOR COMBINATION

CROSS REFERENCE TO RELATED APPLICATIONS

This application is a 371 of international application of PCT/EP2015/054541, filed Mar. 4, 2015, which is herein incorporated by reference in its entirety.

The present invention relates to concentrated detergent compositions comprising a mixture of chelators (complexing agents) for warewashing, especially adapted for the removal of protein soil.

It is known in the field of detergent chemistry that calcium and magnesium ions usually present in hard water can react with components of detergent compositions to form insoluble precipitates. This is a highly unfavorable effect as it causes the formation of scale on cleaned goods and negatively affects the detergent's capacity to remove soil.

Detergents therefore commonly comprise complexing agents that bind to metal ions and thereby reduce the concentration of free metal ions in aqueous systems. Most complexing agents act as polydentate ligands to form chelate complexes with the metal ions. Commonly used complexing agents are, for example, phosphates, citric acid, gluconic acid, methylglycinediacetic acid (MGDA), nitrilotriacetic acid (NTA), ethylenediaminetetraacetic acid (EDTA), diethylenetriaminepentaacetic acid (DTPA), hydroxyethylenediaminetriacetic acid (HEDTA), or iminodisuccinate (IDS).

By binding free magnesium or calcium ions, complexing agents reduce water hardness and prevent scale from forming. Complexing agents can also even help to re-dissolve scale by sequestering magnesium or calcium ions that are bound to precipitated scale. Complexing agents thus serve a dual role by both reducing water hardness and re-dissolving scale. Complexing agents further may prevent metal ions from participating in typical chemical reactions, for example the chemical decomposition of peroxide compounds catalyzed by manganese, iron and copper ions. Complexing agents are therefore particularly used to enhance the performance of cleaning compositions comprising peroxide bleaches.

It is known that the quantity of complexing agents required to sequester a given concentration of metal ions depends on the binding stoichiometry of complexing agent to metal ion and on the dissociation constant of the binding equilibrium. Complexing agents for use as water softeners are commonly characterized by their calcium binding capacity, which is a measure for the amount of calcium bound by a given amount of complexing agent at a given pH and temperature. For mixtures of complexing agents it is assumed that the total binding capacity of the mixture is the sum of the individual binding capacities. The total amount of complexing agent required for a detergent application can therefore be calculated as a function of the known calcium binding capacity and the water hardness. Complexing agents are selected based on their calcium binding capacity (or metal binding capacity in general) and their cost. In addition, properties such as toxicology, detergent compatibility, and environmental restrictions have also to be considered.

The present invention deals with mild alkaline detergent compositions for the removal of protein soil in warewashing applications. Mild alkaline detergents are formulated on the basis of alkali carbonate as an alkaline source, in particular sodium carbonate. Protein soil has proven to be particularly difficult to dissolve. It is therefore the object of the present invention to provide a highly efficient detergent composition for the removal of protein soil in warewashing applications.

It has surprisingly been found that the combination of the complexing agents methylglycinediacetic acid (MGDA), glutamic acid N,N-diacetic acid (GLDA) and alkali metal tripolyphosphate (TPP) with a surfactant in a carbonate based detergent composition achieves superior protein stain removal, in particular once the calcium sequestering threshold of the combination of complexing agents (chelants) has been exceeded.

BRIEF DESCRIPTION OF THE DRAWINGS

FIG. 1 shows the arrangement of glasses and ceramic tiles in a dishmachine as described in the Examples where G=glass tumblers, P=plastic tumblers, T=ceramic tiles.

In a first aspect, the present invention therefore relates to a concentrated detergent composition comprising surfactant
alkali metal carbonate,
methylglycinediacetic acid,
glutamic acid N,N-diacetic acid, and
alkali metal tripolyphosphate.

A variety of surfactants can be used in the present composition, such as anionic, nonionic, cationic, and zwitterionic surfactants. The concentrated detergent composition preferably comprises 0.1 to 20% by weight more preferably 0.1 to 15 wt-% and most preferred 0.1 to 10 wt-% surfactant based on the total weight of the concentrated detergent composition.

Suitable anionic surfactants are, for example, carboxylates such as alkylcarboxylates (carboxylic acid salts) and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, alkylether sulfates; and phosphate esters such as alkylphosphate esters. Exemplary anionic surfactants include sodium alkylarylsulfonate, alpha-olefinsulfonate, and fatty alcohol sulfates.

Suitable nonionic surfactants are, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark Pluronic (BASF), and other like nonionic compounds. Silicone surfactants can also be used.

The concentrated detergent composition comprises preferably 0.1 to 20 wt-%, more preferably 0.1 to 15 wt-% and most preferred 0.1 to 10 wt-% non-ionic surfactant based on the total weight of the concentrated detergent composition.

Suitable cationic surfactants include, for example, amines such as primary, secondary and tertiary monoamines with 018 alkyl or alkenyl chains, ethoxylated alkylamines, alkoxylates of ethylenediamine, imidazoles such as a 1-(2-hydroxyethyl)-2-imidazoline, 2-alkyl-1-(2-hydroxyethyl)-2-imidazoline; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, naphthylene-substituted quaternary ammonium chloride such as dimethyl-1-naphthylmethylammonium chloride. The cationic surfactant can be used to provide sanitizing properties.

Suitable zwitterionic surfactants include, for example, betaines, imidazolines, amine oxides, and propinates.

If the concentrated detergent composition is intended to be used in an automatic dishwashing or warewashing machine, the surfactants are preferably selected to provide an acceptable level of foaming when used inside a dishwashing or warewashing machine. It should be understood that warewashing compositions for use in automatic dishwashing or warewashing machines are generally considered to be low-foaming compositions.

In general, the concentrated detergent composition comprises an effective amount of alkali metal carbonate. In the context of the present invention, an effective amount of the alkali metal carbonate is an amount that provides a use solution having a pH of at least 6, preferably a pH of at least 8, more preferably a pH of 9.5 to 11, most preferably 10 to 10.3 measured at room temperature (20° C.). For the purpose of determining the pH of the use solution, this use solution is defined as a solution of 1 g of the concentrated detergent composition dissolved in 1 liter distilled water.

To provide the required alkalinity, the concentrated detergent composition typically comprises at least 5 percent by weight alkali metal carbonate; preferably the composition comprises 10 to 80 percent by weight, more preferably 15 to 70 percent by weight, most preferably 20 to 60 percent by weight alkali metal carbonate.

Suitable alkali metal carbonates are for example sodium or potassium carbonate, sodium or potassium bicarbonate, sodium or potassium sesquicarbonate, and mixtures thereof.

Due to the use of an alkali metal carbonate as alkaline source, other alkaline sources such as alkali metal hydroxides are not required. Preferably, the concentrated detergent composition therefore does not comprise alkali metal hydroxides.

The concentrated detergent composition comprises the complexing agents methylglycinediacetic acid (MGDA), glutamic acid N,N-diacetic acid (GLDA), and alkali metal tripolyphosphate (TPP). In the context of the present invention, methylglycinediacetic acid and glutamic acid N,N-diacetic acid may be used as free acids or as acid salts. Commonly, the sodium salts of the mentioned compounds will be included in the detergent compositions. The alkali metal tripolyphosphate preferably is sodium tripolyphosphate (STPP).

The complexing agents are readily available to the person skilled in the art. For example, the trisodium salt of methylglycinediacetic acid is sold under the trademark Trilon M by BASF, and the tetrasodium salt of glutamic acid N,N-diacetic acid is available under the trademark Dissolvine GL from AkzoNobel.

The concentration of the three complexing agents is usually adjusted based on the amount of alkali metal carbonate present, such that upon dilution of the concentrated composition suitable working concentrations of both the alkali metal carbonate and the complexing agents are obtained. Preferably, the molar ratio of the sum of glutamic acid N,N-diacetic acid, methylglycinediacetic acid and alkali metal tripolyphosphate to alkali metal carbonate is 0.01 to 0.5, more preferably 0.05 to 0.3, most preferably 0.1 to 0.25.

The relative amounts of the three complexing agents may be adjusted in order to maximize the cleaning efficiency. Preferably, the molar ratio of methylglycinediacetic acid to alkali metal tripolyphosphate therefore is 0.14 to 14.3, more preferably 0.5 to 5, most preferably 1.4 to 1.7. In addition, the molar ratio of glutamic acid N,N-diacetic acid to the sum of methylglycinediacetic acid and alkali metal tripolyphosphate preferably is 0.03 to 29, more preferably 0.05 to 2, most preferably 0.08 to 0.45.

In another preferred aspect of the present invention, the total concentration of glutamic acid N,N-diacetic acid, methylglycinediacetic acid and alkali metal tripolyphosphate is 1 to 70% by weight based on the total weight of the concentrated detergent composition, more preferably 10 to 60% by weight, most preferably 20 to 50% by weight. The amount of glutamic acid N,N-diacetic acid preferably is 1 to 30% by weight based on the total weight of the concentrated detergent composition, more preferably 2 to 25% by weight, most preferably 5 to 20% by weight. The amount of methylglycinediacetic acid preferably is 1 to 40% by weight based on the total weight of the concentrated detergent composition, more preferably 5 to 35% by weight, most preferably 10 to 30% by weight. The amount of alkali metal tripolyphosphate preferably is 1 to 40% by weight based on the total weight of the concentrated detergent composition, more preferably 5 to 30% by weight, most preferably 10 to 20% by weight.

The concentrated detergent composition of the present invention may further comprise at least one of the compounds selected from the list consisting of bleaching agents, activating agents, chelating/sequestering agents, silicates, detergent fillers or binding agents, defoaming agents, anti-redeposition agents, enzymes, dyes, odorants, catalysts, threshold polymers, soil suspension agents, antimicrobials, and mixtures thereof.

Suitable bleaching agents include, for example, peroxygen compounds, such as alkali metal percarbonates, in particular sodium percarbonate, alkali metal perborates, alkali metal persulfates, urea peroxide, hydrogen peroxide; and hypochlorites, such as sodium hypochlorite or calcium hypochlorite. These compounds may be used, for example, as sodium lithium, potassium, barium, calcium, or magnesium salts. Preferably, the peroxygen source is an organic peroxide or hydroperoxide compound. More preferably, the peroxygen source is hydrogen peroxide prepared in situ using an electrochemical generator or other means of generating hydrogen peroxide in-situ.

Alkali metal percarbonates are particularly preferred bleaching agents. The bleaching agent may be present in an amount of 5 to 60% by weight based on the total weight of the concentrated detergent composition, preferably 5 to 50% by weight, most preferably 10 to 40% by weight.

If the detergent composition includes a peroxygen compound, an activating agent may be included to further increase the activity of the peroxygen compound. Suitable activating agents include sodium-4-benzoyloxy benzene sulphonate (SBOBS); N,N,N',N'-tetraacetyl ethylene diamine (TAED); sodium-1-methyl-2-benzoyloxy benzene-4-sulphonate; sodium-4-methyl-3-benzoyloxy benzoate; SPCC trimethyl ammonium toluyloxy benzene sulphonate; sodium nonanoyloxybenzene sulphonate, sodium 3,5,5,-trimethyl hexanoyloxybenzene sulphonate; penta acetyl glucose (PAG); octanoyl tetra acetyl glucose and benzoyl tetracetyl glucose. The concentrated detergent composition may comprise an activating agent or a mixture of activating agents at a total concentration of 1 to 8% by weight based on the total weight of the concentrated detergent composition, preferably 2 to 5% by weight.

The detergent composition may comprise further chelating/sequestering agents in addition to the complexing agents mentioned above. Suitable additional chelating/sequestering agents are, for example, citrate, aminocarboxylic acid, condensed phosphate, phosphonate, and polyacrylate. A chelating agent in the context of the present invention is a molecule capable of coordinating (i.e., binding) the metal ions commonly found in natural water to prevent the metal ions from interfering with the action of the other detersive ingredients of a cleaning composition. Chelating/sequestering agents can generally be referred to as a type of builder. The chelating/sequestering agent may also function as a threshold agent when included in an effective amount. The concentrated detergent composition can include 0.1 to 70% by weight of a chelating/sequestering agent based on the total weight of the concentrated detergent composition, preferably 5 to 60% by weight, more preferably 5 to 50% by weight, most preferably 10 to 40% by weight.

Suitable aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA).

Examples of condensed phosphates include sodium and potassium orthophosphate, sodium and potassium pyrophosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$(HEDP); amino tri(methylenephosphonic acid) $N[CH_2PO(OH)_2]_3$; aminotri(methylenephosphonate), sodium salt $(NaO)(HO)P(OCH_2N[CH_2PO(ONa)_2]_2)$; 2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene) triamine(pentamethylenephosphonic acid) $(HO_2)POCH_2N[(CH_2)_6N[CH_2PO(OH)_2]_2]_2$; and phosphorus acid $H_3PO_3$.

Preferred phosphonates are 1-Hydroxy Ethylidene-1,1-Diphosphonic Acid (HEDP), aminotris(methylenephosphonic acid) (ATMP) and Diethylenetriamine penta(methylene phosphonic acid) (DTPMP).

A neutralized or alkaline phosphonate, or a combination of phosphonate with alkali source prior to being added into the mixture such that there is little or no heat or gas generated by a neutralization reaction when the phosphonate is added is preferred. The phosphonate can comprise a potassium salt of an organo phosphonic acid (a potassium phosphonate). The potassium salt of the phosphonic acid material can be formed by neutralizing the phosphonic acid with an aqueous potassium hydroxide solution during the manufacture of the solid detergent. The phosphonic acid sequestering agent can be combined with a potassium hydroxide solution at appropriate proportions to provide a stoichiometric amount of potassium hydroxide to neutralize the phosphonic acid. A potassium hydroxide having a concentration of from about 1 to about 50 wt can be used. The phosphonic acid can be dissolved or suspended in an aqueous medium and the potassium hydroxide can then be added to the phosphonic acid for neutralization purposes.

The chelating/sequestering agent may also be a water conditioning polymer that can be used as a form of builder. Exemplary water conditioning polymers include polycarboxylates. Exemplary polycarboxylates that can be used as water conditioning polymers include polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers.

The concentrated detergent composition may include the water conditioning polymer in an amount of 0.1 to 20% by weight based on the total weight of the concentrated detergent composition, preferably 0.2 to 5% by weight.

Silicates may be included in the concentrated detergent composition as well. Silicates soften water by the formation of precipitates that can be easily rinsed away. They commonly have wetting and emulsifying properties, and act as buffering agents against acidic compounds, such as acidic soil. Further, silicates can inhibit the corrosion of stainless steel and aluminium by synthetic detergents and complex phosphates. A particularly well suited silicate is sodium metasilicate, which can be anhydrous or hydrated. The concentrated detergent composition may comprise 0.1 to 10% by weight silicates based on the total weight of the concentrated detergent composition.

The composition can include an effective amount of detergent fillers or binding agents. Examples of detergent fillers or binding agents suitable for use in the present composition include sodium sulfate, sodium chloride, starch, sugars, and $C_1$-$C_{10}$ alkylene glycols such as propylene glycol. The detergent filler may be included an amount of 1 to 20% by weight based on the total weight of the concentrated detergent composition, preferably 3 to 15% by weight.

A defoaming agent for reducing the stability of foam may also be included in the composition to reduce foaming. The defoaming agent can be provided in an amount of 0.01 to 20% by weight based on the total weight of the concentrated detergent composition.

Suitable defoaming agents include, for example, ethylene oxide/propylene block copolymers such as those available under the name Pluronic N-3, silicone compounds such as silica dispersed in polydimethylsiloxane, polydimethylsiloxane, and functionalized polydimethylsiloxane, fatty amides, hydrocarbon waxes, fatty acids, fatty esters, fatty alcohols, fatty acid soaps, ethoxylates, mineral oils, polyethylene glycol esters, defoaming emulsions and alkyl phosphate esters such as monostearyl phosphate.

The composition can include an anti re-deposition agent for facilitating sustained suspension of soils in a cleaning solution and preventing the removed soils from being redeposited onto the substrate being cleaned. Examples of suitable anti re-deposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. The anti re-deposition agent can be included in an amount of 0.01 to 25% by weight based on the total weight of the concentrated detergent composition, preferably 1 to 5% by weight.

The composition may include enzymes that provide desirable activity for removal of protein-based, carbohydrate-based, or triglyceride-based soil. Although not limiting to the present invention, enzymes suitable for the cleaning composition can act by degrading or altering one or more types of soil residues encountered on crockery thus removing the soil or making the soil more removable by a surfactant or other component of the cleaning composition. Suitable enzymes include a protease, an amylase, a lipase, a gluconase, a cellulase, a peroxidase, a catalase, or a mixture thereof of any suitable origin, such as vegetable, animal, bacterial, fungal or yeast origin. The concentrated detergent composition may comprise 0.01 to 30% by weight enzymes based on the total weight of the concentrated detergent composition, preferably 0.01 to 15% by weight, more preferably 0.01 to 10% by weight, most preferably 0.01 to 8% by weight.

Examples of proteolytic enzymes which can be employed in the cleaning composition of the invention include (with trade names) Savinase®; a protease derived from *Bacillus lentus* type, such as Maxacal®, Opticlean®, Durazym®, and Properase®; a protease derived from *Bacillus licheniformis*, such as Alcalase®, Maxatase®, Deterzyme®, or Deterzyme PAG 510/220; a protease derived from *Bacillus amyloliquefaciens*, such as Primase®; and a protease derived from *Bacillus alcalophilus*, such as Deterzyme APY. Exemplary commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; those sold under the tradenames Deterzyme®, Deterzyme APY, and Deterzyme PAG 510/220 by Deerland Corporation, and the like.

Preferred proteases will provide good protein removal and cleaning performance, will not leave behind a residue, and will be easy to formulate with and form stable products. Savinase®, commercially available from Novozymes, is a serine-type endo-protease and has activity in a pH range of 8 to 12 and a temperature range from 20° C. to 60° C. Savinase is preferred when developing a liquid concentrate. A mixture of proteases can also be used. For example, Alcalase®, commercially available from Novozymes, is derived from *Bacillus licheniformis* and has activity in a pH range of 6.5 to 8.5 and a temperature range from 45° C. to 65° C. And Esperase®, commercially available from Novozymes, is derived from *Bacillus* sp. and has an alkaline pH activity range and a temperature range from 50° C. to 85° C. A combination of Esperase and Alcalase is preferred when developing a solid concentrate because they form a stable solid. In some aspects, the total protease concentration in the concentrate product is from about 1 to about 15% by weight, from about 5 to about 12% by weight, or from about 5 to about 10% by weight. In some aspects, there is at least 1-6 parts of Alcalase for every part of Esperase (e.g., Alcalase:Esperase of 1:1, 2:1, 3:1, 4:1, 5:1, or 6:1).

Detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease is preferably at least 80% homologous, preferably having at least 80% sequence identity, with the amino acid sequences of the proteases in these references.

Mixtures of different proteolytic enzymes may be incorporated into the disclosed compositions. While various specific enzymes have been described above, it is to be understood that any protease which can confer the desired proteolytic activity to the composition may be used.

The disclosed compositions can optionally include different enzymes in addition to the protease. Exemplary enzymes include amylase, lipase, cellulase, and others.

Exemplary amylase enzymes can be derived from a plant, an animal, or a microorganism. The amylase may be derived from a microorganism, such as yeast, mold, or bacterium. Exemplary amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant).

Exemplary amylase enzymes include those sold under the trade name Rapidase by Gist-Brocades® (Netherlands); those sold under the trade names Termamyl®, Fungamyl® or Duramyl® by Novo; those sold under the trade names Purastar STL or Purastar OXAM by Genencor; those sold under the trade names Thermozyme® L340 or Deterzyme® PAG 510/220 by Deerland Corporation; and the like. A mixture of amylases can also be used.

Exemplary cellulase enzymes can be derived from a plant, an animal, or a microorganism, such as a fungus or a bacterium. Cellulases derived from a fungus include the fungus *Humicola insolens, Humicola* strain DSM1800, or a cellulase 212-producing fungus belonging to the genus *Aeromonas* and those extracted from the hepatopancreas of a marine mollusk, Dolabella Auricula Solander. The cellulase can be purified or a component of an extract, and either wild type or variant (either chemical or recombinant).

Examples of cellulase enzymes include those sold under the trade names Carezyme® or Celluzyme® by Novo; under the tradename Cellulase by Genencor; under the tradename Deerland Cellulase 4000 or Deerland Cellulase TR by Deerland Corporation; and the like. A mixture of cellulases can also be used.

Exemplary lipase enzymes can be derived from a plant, an animal, or a microorganism, such as a fungus or a bacterium. Exemplary lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Exemplary lipase enzymes include those sold under the trade names Lipase P "Amano" or "Amano-P" by Amano Pharmaceutical Co. Ltd., Nagoya, Japan or under the trade name Lipolase® by Novo, and the like. Other commercially available lipases include Amano-CES, lipases derived from *Chromobacter viscosum*, e.g. *Chromobacter viscosum* var. lipolyticum NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*. A preferred lipase is sold under the trade name Lipolase® by Novo. A mixture of lipases can also be used.

Additional suitable enzymes include a cutinase, a peroxidase, a gluconase, and the like. Exemplary cutinase enzymes are described in WO 8809367 A to Genencor. Exemplary peroxidases include horseradish peroxidase, ligninase, and haloperoxidases such as chloro- or bromo-peroxidase. Exemplary peroxidases are also disclosed in WO 89099813 Pc and WO 8909813 A to Novo. These additional enzymes can be derived from a plant, an animal, or a microorganism. The enzyme can be purified or a component of an extract, and either wild type or variant (either chemical or recombinant). Mixtures of different additional enzymes can be used.

According to the present invention, however, to achieve superior protein stain removal the presence of one or more enzymes in the concentrated detergent composition is not a prerequisite.

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), and Acid Green 25 (Ciba-Geigy).

Fragrances or perfumes that may be included in the compositions include, for example, terpenoids such as citronellol, aldehydes such as amyl cinnamaldehyde, a jasmine such as C1S-jasmine or jasmal, and vanillin.

The concentrated detergent composition may be provided, for example, in the form of a solid, a powder, a liquid, a gel or a paste. Preferably, the concentrated detergent composition is provided in the form of a solid or a powder.

The components used to form the concentrated detergent composition can include an aqueous medium such as water as an aid in processing. It is expected that the aqueous medium will help provide the components with a desired viscosity for processing. In addition, it is expected that the aqueous medium may help in the solidification process when is desired to form the concentrated detergent composition as a solid. When the concentrated detergent composition is provided as a solid, it can, for example, be provided in the form of a block or pellet. It is expected that blocks will have a size of at least about 5 grams, and can include a size of greater than about 50 grams. It is expected that the concentrated detergent composition will include water in an amount of 0.001 to 50% by weight based on the total weight of the concentrated detergent composition, preferably 2 to 20% by weight.

When the components that are processed to form the concentrated detergent composition are processed into a block, it is expected that the components can be processed by a known solidification technique, such as for example extrusion techniques or casting techniques. In general, when the components are processed into a block, the amount of water present in the concentrated detergent composition should be 0.001 to 40% by weight based on the total weight of the concentrated detergent composition, preferably 0.001 to 20% by weight. If the components are processed by extrusion techniques, it is believed that the concentrated detergent composition can include a relatively smaller amount of water as an aid for processing compared with the casting techniques. In general, when preparing the solid by extrusion, it is expected that the concentrated detergent composition can contain 0.001 to 20% by weight water based on the total weight of the concentrated detergent composition. When preparing the solid by casting, it is expected that the amount of water is 0.001 to 40% by weight based on the total weight of the concentrated detergent composition.

In a second aspect the present invention relates to a use solution of the concentrated detergent composition. The use solution is an aqueous solution of 0.1 to 10 g concentrated detergent composition per liter of the aqueous solution, preferably 0.5 to 5 g/l, most preferably 1 to 1.5 g/I.

Due to the presence of complexing agents it is possible to formulate a use solution on the basis of hard water. The term "hard water" used herein is defined based on the concentration of $CaCO_3$. According to the US Geological Survey, water having a concentration of at least 61 mg/l $CaCO_3$ is qualified as moderately hard water, a concentration of at least 121 mg/l $CaCO_3$ is qualified as hard water, and a concentration of at least 181 mg/l $CaCO_3$ as very hard water.

Generally, the present invention is not limited to the case of hard water. In a preferred aspect, however, the water used to prepare the use solution has a hardness of at least 50 mg/l $CaCO_3$, more preferably at least 61 mg/l $CaCO_3$, even more preferably at least 85 mg/l, most preferably at least 121 mg/l.

Exemplary ranges of the detergent compositions according to the invention are shown in the following table 1 in weight percentage of the liquid detergent compositions. The compositions of the invention can be formed in a concentrated water-free, aqueous, or a thickened aqueous liquid concentrate for use in forming a use composition.

TABLE 1

| Component | Exemplary Formula 1 | Exemplary Formula 2 | Exemplary Formula 3 | Exemplary Formula 4 | Exemplary Formula 5 |
|---|---|---|---|---|---|
| Alkali metal carbonate | 10-80 | 15-70 | 20-60 | 26-53 | 20-60 |
| MGDA | 1-40 | 5-35 | 10-30 | 10-21 | 5-25 |
| GLDA | 1-30 | 2-25 | 5-20 | 5-10 | 2-15 |
| STPP | 1-40 | 5-30 | 10-20 | 6-14 | 5-17 |
| Nonionic Surfactant | 0.1-20 | 0.1-15 | 0.1-10 | 1-2 | 0.5-5 |
| Additional components | 1-51 | 1-51 | 1-51 | 1-51 | 1-51 |

In a third aspect the present invention also relates to the use of a concentrated detergent composition as described above as a warewashing detergent for the removal of protein soil. The concentrated detergent composition may therefore be generally be used as a warewashing detergent for the removal of solid comprising protein.

Preferably, the concentrated detergent composition is diluted at a concentration of 0.1 to 10 g of concentrated detergent composition per liter of the final solution, preferably 0.5 to 5 g/I, most preferably 1 to 1.5 g/I to provide a use solution. Importantly, the present invention allows using hard water for dilution of the detergent composition. In a preferred aspect, the concentrated detergent composition is therefore diluted with water having a hardness of at least 50 mg/l $CaCO_3$, more preferably at least 61 mg/l $CaCO_3$, even more preferably at least 85 mg/I, most preferably at least 121 mg/l to provide a use solution.

EXAMPLES

Warewash Test Procedures 7 and 10 cycle warewash testing was performed using twelve 10 oz. Libbey glasses, four plastic tumblers and four ceramic tiles in a Robart AM-15 warewash machine and 10 grain water (1 grain=17 ppm). The specifications of the Hobart AM-15 warewash machine are as follows:

Wash tank volume: 53 L
Rinse volume: 2.8 L
Wash time: 40 sec.
Rinse time: 10 sec.

The detergent composition is as follows (Table 2):

TABLE 2

| Component | EXP #1 | EXP #2 | EXP #3 | EXP #4 | EXP #5 | EXP #6 | EXP #7 | EXP #8 | EXP #9 | EXP #10 | EXP #11 |
|---|---|---|---|---|---|---|---|---|---|---|---|
| Alkali metal carbonate | 52.63 | 44.25 | 32.89 | 24.75 | 44.64 | 35.21 | 26.05 | 36.46 | 41.67 | 46.88 | 52.09 |
| MGDA | 45.26 | 53.98 | | | | | 10.50 | 14.70 | 16.80 | 18.90 | 21.00 |
| GLDA | | | 65.79 | 74.26 | | | 5.00 | 7.00 | 8.00 | 9.00 | 10.00 |
| STPP | | | | | 53.57 | 63.38 | 6.79 | 9.51 | 10.86 | 12.22 | 13.58 |
| Nonionic Surfactant | 2.11 | 1.77 | 1.32 | 0.99 | 1.79 | 1.41 | 1.00 | 1.40 | 1.60 | 1.80 | 2.00 |
| Additional components | | | | | | | 50.67 | 30.93 | 21.06 | 11.20 | 1.33 |

Seven-Cycle Film Evaluation for Institutional Warewash Detergents

Principle:

Test glasses are washed in an institutional warewash machine with a predetermined concentration of detergent and food soil. Some of the test glasses are completely dipped in a 1:1 whole milk:Cream of Chicken Soup mixture and dried before each cycle. Other glasses are left untreated and examined for soil redeposit. Some of the test ceramic tiles are completely painted in a 1:1 whole milk:Cream of Chicken Soup mixture and dried before each cycle. Other ceramic tiles are left untreated and examined for soil redeposit.

Apparatus and Materials:

1. Institutional machine hooked up to the appropriate water supply
2. Rabum glass rack
3. Libbey heat resistant glass tumblers, 10 oz.
4. Cambro Newport plastic tumblers
5. Ceramic tiles
6. Sufficient detergent to complete the test
7. Hot Point Soil
8. Titrator and reagents to titrate alkalinity
9. Water hardness test kit Hot Point Soil:

A 50/50 combination of beef stew and hot point soil was used at 2000 ppm. The soil consisted of the following ingredients:

1.) 2 cans of Dinty Moore Beef Stew (1360 g)
2.) 1 large can of tomato sauce (822 g)
3.) 15.5 sticks of Blue Bonnet Margarine (1746. g)
4.) Powdered milk (436.4 g)

Preparation:

1. Collect 12 clean glasses, 4 new plastic tumblers and 4 ceramic tiles.
2. Fill the dishmachine with the appropriate water. Test the water for hardness. Record the value.
3. Turn on the dishmachine and run wash/rinse cycles through the machine until a wash temperature of 150-160° F. and rinse temperature of 175-190° F. is reached.
4. Manually add the appropriate amount of detergent to the wash tank to reach the desired detergent concentration.
5. Manually add the appropriate amount of hot point food soil to the wash tank for a total of 2000 ppm food soil.
6. Manually weigh out the appropriate amount of detergent to maintain the desired concentration in the dishmachine into six separate vessels (i.e. plastic tumblers). Additionally, weigh out the appropriate amount hot point food soil to maintain the desired concentration in the dishmachine into the same six vessels.
7. Place 12 dean glasses, 4 plastic tumblers and 4 ceramic tiles in the Rabum rack (see FIG. 1 for arrangement) and place the rack inside the dishmachine.
8. Fill a small plastic hotel pan (Carlisle TopNotch® One-Ninth Size Pan 6-¾"4¼"—Clear—1032007) with a 1:1 (v/v) mixture of whole milk:Campbell's Cream of Chicken Soup. Roll 6 glass tumblers and 2 plastic tumblers 3 times in the 1:1 mixture of whole milk:chicken soup and place them in the custom built drying apparatus. It is very important that the coated glasses are placed in the same position in the rack and drying apparatus throughout the test. In addition, optionally, paint a very thin film of the 1:1 (v/v) mixture of whole milk:Campbell's Cream of Chicken Soup onto two ceramic tiles, with a foam brush. Place the drying apparatus in an oven at 1600° F. for 8 minutes. This process of coating glasses (and the ceramic tiles) will be repeated before each cycle of the test. Place the glasses, plastic tumblers and ceramic tiles in the positions on the rack as shown in FIG. 1.
9. A mirror image of the first 3 columns of the rack should be copied onto columns 4, 5 and 6, like in the above diagram, with the exception that these substrates should not be soiled with whole milk or the 1:1 mixture of chicken soup. These glasses, plastic tumblers and ceramic tumblers will be referred to as redeposit glasses/tumblers/tiles because they are used to evaluate the ability of the machine and/or detergent to prevent redeposit of food soils. After drying for 8 minutes, place the substrates (glasses, tumblers, tiles) as is pictured above.
10. Place the rack into the machine, close the door, and run a cycle. Be careful to place the rack in the same position for each cycle.
11. After each cycle, add the appropriate amount of hot point soil to maintain a sump concentration of 2000 ppm. At the same time add the appropriate amount of detergent to maintain the detergent concentration at the desired level.
12. Repeat a complete cycle a total of 7 times.
13. Allow the rack of glasses, tumblers and tiles to dry at least 24 hours prior to grading.

Combined Seven/Ten-Cycle Film Evaluation for Institutional Warewash Detergents:

Same as the seven cycle test described above with the exception of steps 8 and 12. Step 8 should be replaced by the steps below. In this test, step 12 should read "Repeat a complete cycle a total of 10 times."

8. Fill a small plastic hotel pan (Carlisle TopNotch® One-Ninth Size Pan 6-¾"×4-114"—Clear—1032007) with whole milk. Roll 6 of the processed glasses completely in the whole milk and place in the custom built drying apparatus according to the glass orientation in the rack in no. 2. It is very important that the coated glasses are placed in the same position in the rack and drying apparatus throughout the test. Place the drying apparatus in a Lab-Line humidity chamber at 100° F. and 65% RH for 8 minutes. This process of coating glasses will be repeated before each cycle of the test. Place the glasses in the Raburn glass rack after they have been dried. Fill a small plastic hotel pan (Carlisle TopNotch® One-Ninth Size Pan 6-¾"×4-114"—Clear—1032007) with a 1:1 (v/v) mixture of whole milk:Campbell's Cream of Chicken Soup. Roll 2 plastic tumblers 3 times in the 1:1 mixture of whole milk:chicken soup and place them in the custom built drying apparatus. It is very important that the coated glasses are placed in the same position in the rack and drying apparatus throughout the test. In addition, optionally, paint a very thin film of the 1:1 (v/v) mixture of whole milk:Campbell's Cream of Chicken Soup onto two ceramic tiles, two stainless steel coupons and the exterior of two glasses with a foam brush. Place the drying apparatus in an oven at 160° F. for 8 minutes. This process of coating glasses (and optionally on the ceramic tiles and/or stainless steel coupons) will be repeated before each cycle of the test. Place the glasses in the Raburn glass rack after they have been dried. Place the glasses, plastic tumblers and ceramic tiles in the positions on the rack as shown above.

Interpretation of Results:

The glasses and tumblers were allowed to dry overnight and were then graded for spots and film accumulation. The glasses, tumblers and ceramic tiles were stained with coomassie blue to determine protein residue. Rating was performed according to Table 3.

TABLE 3

| Rating | Spots | Film | Protein |
|---|---|---|---|
| 1 | No Spots | No Film | No blue color |
| 2 | Spots at random | 20% of surface covered in film | Surface covered in a very slight blue film |
| 3 | ¼ glass spotted | 40% of the surface covered in film | Surface covered in a blue film |
| 4 | ½ glass spotted | 60% of the surface covered in film | Surface covered in a moderately dark blue film |
| 5 | Whole glass spotted | At least 80% of the surface covered in film | Surface covered in a dark blue film |

Results of the 7 Cycle Testing are summarized in Table 4, results of the 10 Cycle Testing are summarized in Table 5.

TABLE 4

| Formula | Conc. (ppm) | 7 cycle test results | | | | | |
|---|---|---|---|---|---|---|---|
| | | Glass ratings (protein) | | Plastic ratings (protein) | | Ceramic ratings (protein) | |
| | | Soiled | Redep. | Soiled | Redep. | Soiled | Redep. |
| EXP #1 | 950 | 3 | 1 | 3 | 1 | 3 | 1 |
| EXP #2 | 1130 | 1.5 | 1 | 1.5 | 1 | 1 | 1 |
| EXP #3 | 1520 | 3.5 | 3.5 | 1.5 | 1.5 | 3 | 1 |
| EXP #4 | 2020 | 1 | 1 | 1 | 1 | 1 | 1 |
| EXP #5 | 1120 | 2 | 1 | 2 | 1 | 3 | 1 |
| EXP #6 | 1420 | 1 | 1 | 1 | 2 | 1 | 1 |
| EXP #8 | 2000 | 2.5 | 1.5 | 2.5 | 1.5 | 3 | 1 |
| EXP #9 | 2000 | 2 | 1 | 2.5 | 1.5 | 2 | 1 |
| EXP #10 | 2000 | 1 | 1 | 1 | 1 | 1 | 1 |

TABLE 5

| Formula | Conc. (ppm) | 10 cycle test results | | | | | |
|---|---|---|---|---|---|---|---|
| | | Glass ratings | | Plastic ratings | | Ceramic ratings | |
| | | protein (soiled) | protein (redep) | protein (soiled) | protein (redep) | protein (soiled) | protein (redep) |
| Ash formula w/low chelant | 1000 | 4 | 3 | 4 | 3 | 5 | 2 |
| Ash formula w/low chelant | 2000 | 4 | 2 | 4 | 2 | 5 | 2 |
| Ash formula w/protease | 1000 | 2 | 1.5 | 2.5 | 1.5 | 2 | 1 |
| Ash formula w/protease | 2000 | 2 | 1.25 | 3 | 1.25 | 2 | 1 |
| EXP #11 | 1000 | 3.5 | 2 | 3.5 | 2 | 4 | 2 |
| EXP #11 | 2000 | 1.5 | 1.25 | 2 | 1.5 | 2 | 1 |

The compositions of EXP #7 to 11 comprising the three chelators MGDA, GLDA and STPP show better soil removal compared to the compositions comprising only one of these chelators. Table 5 shows that EXP #11 has a better protein removal and less redeposition than the compositions of the state of the art with enzyme or lower amounts of chelant. Lower amounts of chealnts are used in detergents of the state of the art as complexing agent.

The invention claimed is:

1. A concentrated detergent composition comprising:
from 0.5 wt. % to 5 wt. % of a nonionic surfactant,
at least 52 wt. % of an alkali metal carbonate, and
chelating/sequestering agents, wherein the chelating/sequestering agents comprise of from 5 wt. % to 25 wt. % of methyl glycine diacetic acid, from 5 wt. % to 10 wt. % glutamic acid N,N-diacetic acid, and from 5 wt. % to 17 wt. % of an alkali metal tripolyphosphate;
wherein the detergent composition removes protein soil;
wherein the total quantity of the chelating/sequestering agents is less than 45 wt. % of the composition; and
wherein the molar ratio of the glutamic acid N,N-diacetic acid to the sum of the methyl glycine diacetic acid and the alkali metal tripolyphosphate is 0.05 to 2 further wherein the wt % of each component is based on the total weight of the composition.

2. The concentrated detergent composition according to claim 1, wherein the composition comprises from 60 wt. % to 80 wt. % alkali metal carbonate.

3. The concentrated detergent composition according to claim 1, wherein the molar ratio of methyl glycine acid to alkali metal tripolyphosphate is 0.14 to 14.3.

4. The concentrated detergent composition according to claim 1, wherein the nonionic surfactant is selected from polyethylene glycol ethers of fatty alcohols, polyalkylene oxide free nonionics, sorbitan esters and ethoxylates thereof, sucrose esters and ethoxylates thereof, alkoxylated ethylene diamines, alcohol alkoxylates, nonylphenol ethoxylates, polyoxyethylene glycol ethers, carboxylic acid esters and ethoxylates thereof, carboxylic amides, polyalkylene oxide block copolymers, ethylene oxide-propylene oxide block copolymers, or a combination thereof.

5. The concentrated detergent composition according to claim 1, wherein the molar ratio of the sum of glutamic acid N,N-diacetic acid, methyl glycine diacetic acid and alkali metal tripolyphosphate to alkali metal carbonate is 0.01 to 0.5.

6. The concentrated detergent composition according to claim 1, wherein the alkali metal carbonate is sodium or potassium carbonate, sodium or potassium bicarbonate, sodium or potassium sesquicarbonate, or a combination thereof.

7. The concentrated detergent composition according to claim 1, wherein the alkali metal tripolyphosphate is sodium tripolyphosphate.

8. The concentrated detergent composition according to claim 1, wherein the composition provides a pH of at least 6 when diluted in distilled water at a concentration of 1 g/l and measured at 20° C.

9. The concentrated detergent composition according to claim 1, wherein the composition further comprises one or more of bleaching agents, activating agents, silicates, detergent fillers or binding agents, defoaming agents, anti-redeposition agents, enzymes, dyes, odorants, catalysts, threshold polymers, soil suspension agents, antimicrobials or a combination thereof.

10. The concentrated detergent composition according to claim 1, wherein the composition is provided in the form of a solid, a powder, a liquid, a gel, or a paste.

11. A method of removing soil comprising protein in an automatic dishwashing machine, said method comprising contacting a soiled surface with the composition according to claim 1.

12. The method according to claim 11, wherein the concentrated detergent composition is diluted to provide a use solution with a concentration of 0.1 to 10 g/l.

13. The method according to claim 12, wherein the concentrated detergent composition is diluted with water having a hardness of at least 50 mg/l $CaCO_3$.

* * * * *